US009845178B2

(12) United States Patent
Meinzinger

(10) Patent No.: US 9,845,178 B2
(45) Date of Patent: Dec. 19, 2017

(54) COMPRESSIBLE PLASTIC CONTAINER WITH BASE CUP

(71) Applicant: KRONES AG, Neutraubling (DE)

(72) Inventor: Rupert Meinzinger, Kirchroth (DE)

(73) Assignee: KRONES AG (DE)

( * ) Notice: Subject to any disclaimer, the term of this patent is extended or adjusted under 35 U.S.C. 154(b) by 0 days.

(21) Appl. No.: 14/857,990

(22) Filed: Sep. 18, 2015

(65) Prior Publication Data

US 2016/0090215 A1 Mar. 31, 2016

(30) Foreign Application Priority Data

Sep. 25, 2014 (DE) ..... 10 2014 113 915

(51) Int. Cl.

| | |
|---|---|
| ***B65D 1/02*** | (2006.01) |
| ***B65D 35/02*** | (2006.01) |
| ***B65D 35/08*** | (2006.01) |
| ***B65D 21/02*** | (2006.01) |
| ***B65D 23/00*** | (2006.01) |
| ***B65D 25/28*** | (2006.01) |

(52) U.S. Cl.

CPC ..... *B65D 35/08* (2013.01); *B65D 1/0292* (2013.01); *B65D 21/023* (2013.01); *B65D 21/0209* (2013.01); *B65D 23/001* (2013.01); *B65D 25/28* (2013.01)

(58) Field of Classification Search

CPC .. B65D 35/08; B65D 21/0209; B65D 21/086; B65D 25/28; B65D 1/0292; Y10S 215/90; B67D 1/0001; B67D 1/0829

USPC ..... 215/900, 396, 383, 395; 220/608, 666, 220/675; 141/114, 313

See application file for complete search history.

(56) References Cited

U.S. PATENT DOCUMENTS

| | | | | | |
|---|---|---|---|---|---|
| 687,790 | A | * | 12/1901 | Scales | B65D 35/12 222/92 |
| 1,690,261 | A | | 11/1928 | Wendle et al. | |
| 4,456,134 | A | * | 6/1984 | Cooper | B65D 1/0292 215/12.1 |
| RE32,379 | E | * | 3/1987 | Touzani | B65D 1/0292 215/372 |
| 4,979,242 | A | * | 12/1990 | Maggio | E04H 1/1244 135/901 |
| 5,206,037 | A | * | 4/1993 | Robbins, III | B29C 53/08 264/295 |

(Continued)

FOREIGN PATENT DOCUMENTS

| | | | |
|---|---|---|---|
| DE | 9316296 | U1 | 3/1994 |
| JP | H04102544 | A | 4/1992 |
| JP | 2012232759 | A | 11/2012 |

*Primary Examiner* — J. Gregory Pickett
*Assistant Examiner* — Gideon Weinerth
(74) *Attorney, Agent, or Firm* — Schmeiser, Olsen & Watts, LLP

(57) ABSTRACT

A container, in particular a plastic container with a base region, a main body which adjoins this base region and is suitable to receive a volume of liquid, and with a mouth region, wherein the container can be compressed along its longitudinal direction for the removal of liquid located in the container is provided. On the base region a base cup is disposed which forms a base surface for the container and which when the container is compressed can also serve as a die element and/or die counter-element for compressing the container.

13 Claims, 6 Drawing Sheets

(56) References Cited

U.S. PATENT DOCUMENTS 5,224,613 A * 7/1993 Robbins, III ..... B29C 53/08 215/10
5,226,551 A * 7/1993 Robbins, III ..... A61G 9/006 215/13.1
5,269,428 A * 12/1993 Gilbert ..... B65D 1/0292 215/376
5,348,173 A * 9/1994 Norwood ..... B65D 1/0292 206/509
5,384,138 A * 1/1995 Robbins, III ..... B29C 53/08 215/10
5,758,789 A 6/1998 Shin et al.
5,860,556 A * 1/1999 Robbins, III ..... B65D 1/0292 220/608
RE36,377 E * 11/1999 Gilbert ..... B65D 23/00 215/382
6,431,411 B1 * 8/2002 Wenner ..... F16N 11/04 184/105.1
6,454,110 B1 * 9/2002 Takeuchi ..... B65D 23/10 215/398
6,662,964 B2 * 12/2003 Higuchi ..... B65D 1/0292 215/11.3
6,669,040 B2 * 12/2003 Higuchi ..... B65D 1/0292 215/381
8,431,068 B2 * 4/2013 Hansen ..... B29C 49/4817 264/500
8,453,860 B2 * 6/2013 Otero ..... B65D 23/02 215/11.3
8,534,478 B2 * 9/2013 Mays, III ..... B65D 21/0231 215/381
9,238,520 B2 * 1/2016 Jeremiah ..... B65D 1/0292
9,546,084 B2 * 1/2017 Meinzinger ..... B67D 1/0001
2003/0102333 A1 * 6/2003 Wright ..... B65D 77/067 222/340
2004/0217084 A1 * 11/2004 Ohlsson ..... B65D 1/0292 215/381
2005/0017015 A1 * 1/2005 Higuchi ..... B65D 1/0292 220/666
2005/0061764 A1 * 3/2005 Tamashiro ..... B65D 7/04 215/12.1
2006/0016819 A1 * 1/2006 Paslawski ..... B65D 1/0292 220/666
2006/0054641 A1 * 3/2006 Evers ..... B67D 1/0001 222/326
2006/0124579 A1 * 6/2006 Nielson ..... B65D 23/104 215/396
2008/0210699 A1 9/2008 Esteve
2010/0140294 A1 * 6/2010 Bourguignon ..... B65D 83/0094 220/666
2012/0227860 A1 * 9/2012 Jeremiah ..... B65D 1/0292 141/1
2012/0248059 A1 10/2012 Saito
2013/0146499 A1 * 6/2013 Hansen ..... B65B 3/022 206/524.8
2014/0151324 A1 6/2014 Limwanawong
2015/0034661 A1 * 2/2015 Cooper ..... B65B 7/2842 220/666
2015/0047299 A1 * 2/2015 John-Unterburger ..... B65B 3/04 53/453
2015/0053716 A1 * 2/2015 Meinzinger ..... B67D 3/0006 222/23
2015/0060485 A1 * 3/2015 Gamburg ..... B65D 85/78 222/95
2015/0315004 A1 * 11/2015 Meinzinger ..... B67D 1/0001 222/95
2015/0321793 A1 * 11/2015 Oved ..... B65D 15/16 215/395
2015/0344181 A1 * 12/2015 Candy ..... B65D 1/0292 215/11.6
2015/0344280 A1 12/2015 Meinzinger et al.
2016/0039570 A1 * 2/2016 Meinzinger ..... B65D 1/02 220/755
2016/0090215 A1 * 3/2016 Meinzinger ..... B65D 21/023 206/277
2016/0207750 A1 * 7/2016 Meinzinger ..... B67C 3/02
2016/0214849 A1 * 7/2016 Krueger ..... B67D 1/0001
2016/0229674 A1 * 8/2016 Meinzinger ..... B67D 1/0001

* cited by examiner

COMPRESSIBLE PLASTIC CONTAINER WITH BASE CUP

CROSS-REFERENCE TO RELATED APPLICATIONS

This application claims priority to German Application No. 10 2014 113 915.1, having a filing date of Sep. 25, 2014, the entire contents of which are hereby incorporated by reference.

FIELD OF TECHNOLOGY

The following relates to a container and in particular a plastic container.

BACKGROUND

Numerous such plastic containers are known. These plastic containers have different filling volumes. Furthermore compressible containers of which the contents can be removed by compression of the container are known. In such a tap system of the applicant PET bottles (BEVkeg) are emptied by deforming the container wall and the container shoulders. For this targeted deformation, in which in particular a mouth region of the containers is pushed into a base region of the containers, shaping parts (in particular dies) which are specially adapted to the container are used in the tap system. These shaping parts are designed on one side as a die, in order to push the container wall inwards and on the other side of the container these shaping parts are formed as supporting cups in which in particular a base region of the plastic containers to be emptied is located. Thus these shaping parts are integrated in a tap system and therefore are also co-ordinated with the respective container shape and container size. Replacement of these shaping parts is possible but only with relative difficulty, which in particular also significantly impedes a changeover to other containers.

SUMMARY

An aspect relates to a container, in particular, a plastic container, having a base region as well as a main body which adjoins this base region and (in particular together with the base region) is suitable to receive a volume of liquid, and furthermore has a mouth region, wherein the container is compressible along its longitudinal direction for the removal of liquid located in the container.

According to embodiments of the invention, on the base region a base cup is disposed which forms a base surface for the container and which when the container is compressed can also serve as a die element and/or die counter-element (i.e. as an element which co-operates with a die) for compressing the container.

It is therefore proposed that the required shaping parts or reshaping parts are fixed in the correct position on the container itself and are preferably supplied therewith. In this case the base cup is preferably designed in such a way that it provides stability on a flat base or floor respectively. Advantageously therefore the base cup is made of a harder material than the base region of the container, so that in the compression operation the base cup is not significantly deformed but the base part which is pushed into this base cup is compressed. In this case it is possible that the base cup together with the container can be disposed and centred in a tap system.

Preferably, therefore, the base cup is formed in such a way that during a process of transforming the container and in particular during a transforming process performed for the purpose of emptying this base cup provides support for the container.

More precisely, the base cup is a base contact element which lies in contact on the base region of the container. In this case it is not absolutely necessary for the base cup to be completely closed in the circumferential direction. This means, that the base cup may optionally also have openings in their wall.

The base region, the main body and the mouth region of the container are preferably formed in one piece. The container preferably has an internal volume which is greater than 5 liters, preferably greater than 10 liters, preferably greater than 15 liters and preferably greater than 20 liters. Particularly preferably a container may have an internal volume of 30 liters. The container is preferably a blow moulded container and in particular a stretch blow moulded container. In particular the container is made of PET.

In a further advantageous embodiment the base cup is disposed by means of at least one fastening means on the base region of the container. In this case it is for example possible that this base cup is adhered and/or clipped on the base region. Since experience shows that the material of the PET large container still expands slightly, the container is naturally "pressed into" the base cup, which may be understood in this context as "clipped on".

In a further advantageous embodiment at least one section of the main body of the container, which in an uncompressed state of the container is located outside a hollow space surrounded by the base cup, is located in a compressed state inside the hollow space surrounded by the base cup. This means that a section of the container can be compressed in the hollow space surrounded by the base cup. In particular this section is a shoulder and/or mouth region of the container which can be pushed appropriately into the base region or the hollow space surrounded by the base cup respectively. The plastic container is preferably formed in such a way that it can be compressed in a defined manner and in particular can be compressed in a defined manner with respect to a fold point. Advantageously in this case during the compression a circumferential fold point or fold edge respectively can be formed and the container can be folded in this way.

In this case, more precisely, the mouth region of the container can be folded into the base region, so that the in particular circumferential fold edge mentioned above is produced. Preferably the base region of the container is formed in such a way that the container could not be disposed on the base region upright on a flat surface. Thus for example the base region could have a hemispherical cross-section. Advantageously at least one hollow space is formed between the base cup and the base region of the container and preferably a circumferential hollow space is formed between the base region of the container and the base cup.

In this case it is preferably possible that a radially inner region of the base cup lies directly in contact on the base region of the container and/or preferably a circumferential edge of the base cup also lies directly in contact on the base region of the container. Between this central region and the circumferential edge a region can be formed in which the base cup is distanced from the base region or the surface of the base region respectively. Advantageously in this case this distanced region is formed in a ring with respect to an axis of symmetry or longitudinal direction of the plastic container respectively. Preferably the region distanced from the base region forms a base surface of the base cup.

In a further advantageous embodiment therefore the base cup can have an annular stand body. This annular stand body can likewise form a circumferential hollow space.

In a further advantageous embodiment an inner wall of the base cup facing the base region of the container is at least in sections adapted to a further die element which serves for compressing the container and which is movable relative to the base region in a longitudinal direction of the container. By this adaptation of the cross-sections it can be achieved that by a compression of the container in its longitudinal direction the volume between the base cups is very greatly limited and thus a large quantity of liquid can be removed from the container or only a small residual content remains in the container respectively.

In a further advantageous embodiment a contact element is disposed on the mouth region of the container, for example adhered or snapped on. This contact element may for example be a carrying element which also serves for carrying of the container. In this case this contact element can also be adhered on the mouth or shoulder region respectively of the container. Advantageously, however, this contact element can also be held by a mouth region such as for instance a carrying ring of the container, for example by means of a clip connection.

In a further advantageous embodiment the contact element is formed as a die element and thus the container is compressible between the base cup and this second die element. In this case an internal surface of the contact element facing the base cup is advantageously adapted to the geometry of the correspondingly opposing internal surface of the base cup, in order in this way as mentioned above to reduce the container volume in the best way possible. In other words, a surface of the base cup lying at least partially in contact on the base region of the container and a surface of the contact element lying at least partially in contact on the mouth region of the container are co-ordinated with one another geometrically in such a way that when the contact element and the base cup are advanced towards one another a distance between these surfaces is defined at least in sections substantially only by a wall of the container. This means that the container is also compressed in these sections in such a way that emptying is possible to the greatest possible extent.

Thus for example both the said surface of the base cup lying in contact on the base region of the container and thus also the corresponding surface of the contact element could be formed in sections spherically.

In a further advantageous embodiment the contact element is geometrically adapted to the base cup in such a way that two similar containers (which are provided with a base cup and a contact element) can be stacked one above the other in a longitudinal direction of the containers. In this case these co-operating surfaces of the contact element and of the base cup are advantageously optimised in such a way that in a stacked state no load, or only the least possible load, is exerted on the mouth of the containers.

In a further advantageous embodiment the second contact element can also serve to receive further elements for the tapping process, such as for example to receive a (one-way) tap line.

In a further advantageous embodiment the contact element has an opening through which a mouth section of the container can be passed. Furthermore the contact element preferably also has a hollow space in which the above-mentioned elements of a tap arrangement can be integrated or stored. However, this said hollow space can also be formed both by wall regions of the container and also by wall regions of the contact element.

In a further advantageous embodiment the base cup and/or the contact element are made from a material which is selected from a group of plastic materials which includes in particular polypropylene (PP) or polyethylene (PE). The base cup and/or the contact element would also be conceivable as a returnable solution. In this case the design would envisage above all metallic materials, in particular die-cast aluminium.

As stated above, the base cup is constructed or designed respectively in such a way that it is capable of taking over the support during the transforming process, i.e. the emptying of the container. As mentioned above, for fastening of the base cup it is possible to adhere it or snap it on, which can take place on the body or on a separate shaped area of the container.

The contact element or the die respectively is preferably located on the shoulder of the container and can be fixed by means of the carrying ring. In this case a supporting surface of the contact element is preferably designed so that by means of the internal pressure of the container the weight of the container can be stacked a number of times. Preferably in addition to the required reshaping geometry the die is designed so that the stacked container is centred and/or that preferably the container is also centred in a tap device. The contact element can be designed so that it can be extend, so that grips for carrying are present and/or in such a way, that a hollow space can close, in order for example to receive a one-way line. The base cup and the contact element are preferably co-ordinated with one another in such a way that in a stacked state the closure of the container is not excessively loaded. These elements can preferably be designed in such a way that a flux of force, in particular a flux of force in a vertical direction, does not extend over the container closure or regions of the container closure. Thus for example the container closure could be retracted in the longitudinal direction of the container relative to the contact element.

Thus with the base cup a very good stability is produced, which is advantageous for the storage and the transport. With this substantial stability individual containers can be commissioned more easily. In this case it is advantageous if individual containers can be transported without additional packaging means and/or separately from a bulk pack. The stacking without additional elements such as for example pallets is advantageous not only for transport in a sea container without pallets, but also for storage in the cold store at the consumer's premises.

In addition the base cup preferably offers considerable transport protection when the container is moved by hand. The container base is protected against damage so that for example even in the event of careless handling the container is not scratched or damaged in a critical region so that it leaks. Such careless handling could for example be the hard placing of containers on a floor or the lugging of a container (often weighing up to 20 kilos) over the floor.

In the event of any contaminations of the containers, for example if a container on a pallet has been clumsily destroyed by a fork lift truck, the formation of mould can be prevented by hygienic provisions such as for example flushing with water.

The base cup and the contact element are preferably designed to be watertight and preferably any puddles are prevented by holes, in particular holes in the base cup. The good stability makes the tap system easier to operate. More precisely the container can simply be set down on a platform. In addition a carrying handle which is preferably provided on the container makes it easier to carry it and to position it on a platform. This carrying handle can in this case be formed in the contact element. Thus the contact element could have a body which extends in the circumferential direction with respect to the longitudinal direction of the container and in which holding sections such as for instance gripping recesses or the like are formed.

If the base cup is already attached to the container there is no longer a risk that the container no longer fits in the base cup. On the contrary, the container can expand over time and due to temperature and thus can reinforce the press fit inside the base cup.

This leads to an improvement in the functional reliability of the tap system. Provisions have been made in the tap device specifically because of the expansion of the container, and thus these are no longer required since such expansions of the container no longer affect the compression process and on the other hand the base cup and the contact element do not expand.

A further advantage of a tap system to be used is that, when the base cup and the contact segment or the die respectively with the container are changed a change of format is also possible. Thus not only different volumes can be tapped, but also different shapes can be used in order to enable a certain freedom for individual container configuration. Thus the so-called branding is likewise possible. If shaping parts are attached to the container at both ends, the container is perceived even more as a keg, resulting in a higher market acceptance. The greatest advantage lies in the cost saving, which not only results from the reduced packaging but costs can also be saved in the tap device.

BRIEF DESCRIPTION

Some of the embodiments will be described in detail, with reference to the following figures, wherein like designations denote like members, wherein.

DETAILED DESCRIPTION

Figure 1:
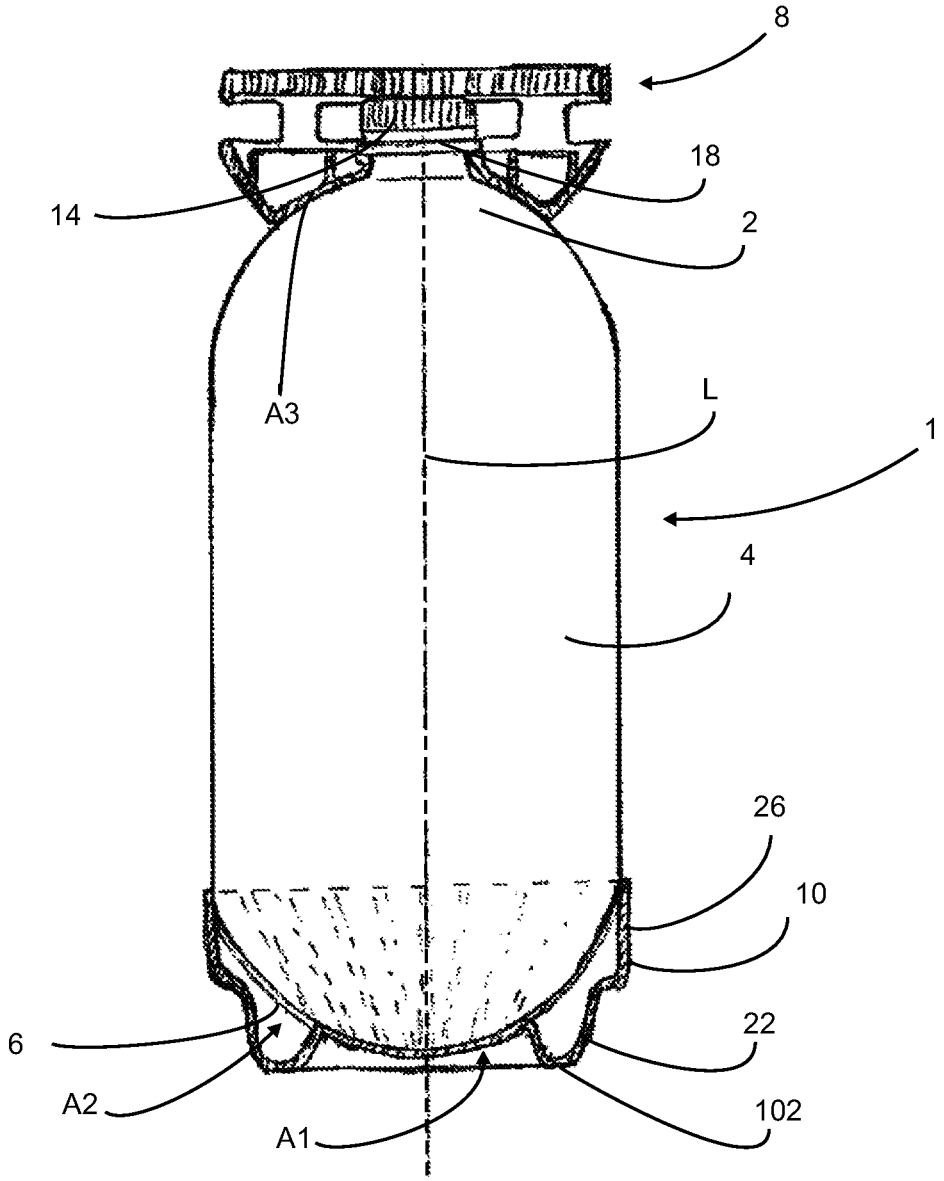
FIG. 1 shows a schematic representation of a container.

FIG. 1 shows a side view of a container 1 according to embodiments of the invention. This container 1 has a base region 6 adjoined by a main body 4. This main body 4 in turn adjoins a mouth or shoulder region 2 respectively. In this case the majority of a liquid in the container is located in the region surrounded by the main body of the container. The reference numeral L designates a longitudinal direction of the container along which the container 1 is also compressed.

The reference numeral 10 designates a base cup which is disposed on the base region. In this case it can be seen that in a region A1 this base cup lies directly in contact on the base region 6 and in a further region A2 is distanced from the base region. In this case the region A1, along which the base cup 10 lies in contact on the base region 6, is of rotationally symmetrical or circular construction respectively (when viewed in a projection along the longitudinal direction L). Furthermore, however, the surface A2 along which the base cup does not lie in contact on the base region 6 is of annular construction and extends here in a curved manner and in this section merges into the main body 4.

The reference numeral 8 designates a contact element which lies in contact on the shoulder region of the container. In this case again a region A3 can be seen in which this contact element lies in contact on the shoulder 2 of the container. The reference numeral 14 designates a closure on which the container is disposed. In this case it is possible that this contact element 8 is held between the shoulder region 2 and a carrying ring 18 of the container. In a compression operation of the container 1 this contact element 8 acts as a die and in particular co-operates with the base cup 10. Thus the container is compressed in particular in its longitudinal direction between the contact element and the base cup. The reference numeral 22 relates to a supporting foot region of the base cup 10 and the reference numeral 26 relates to a circumferential and vertical wall section.

Figure 2:
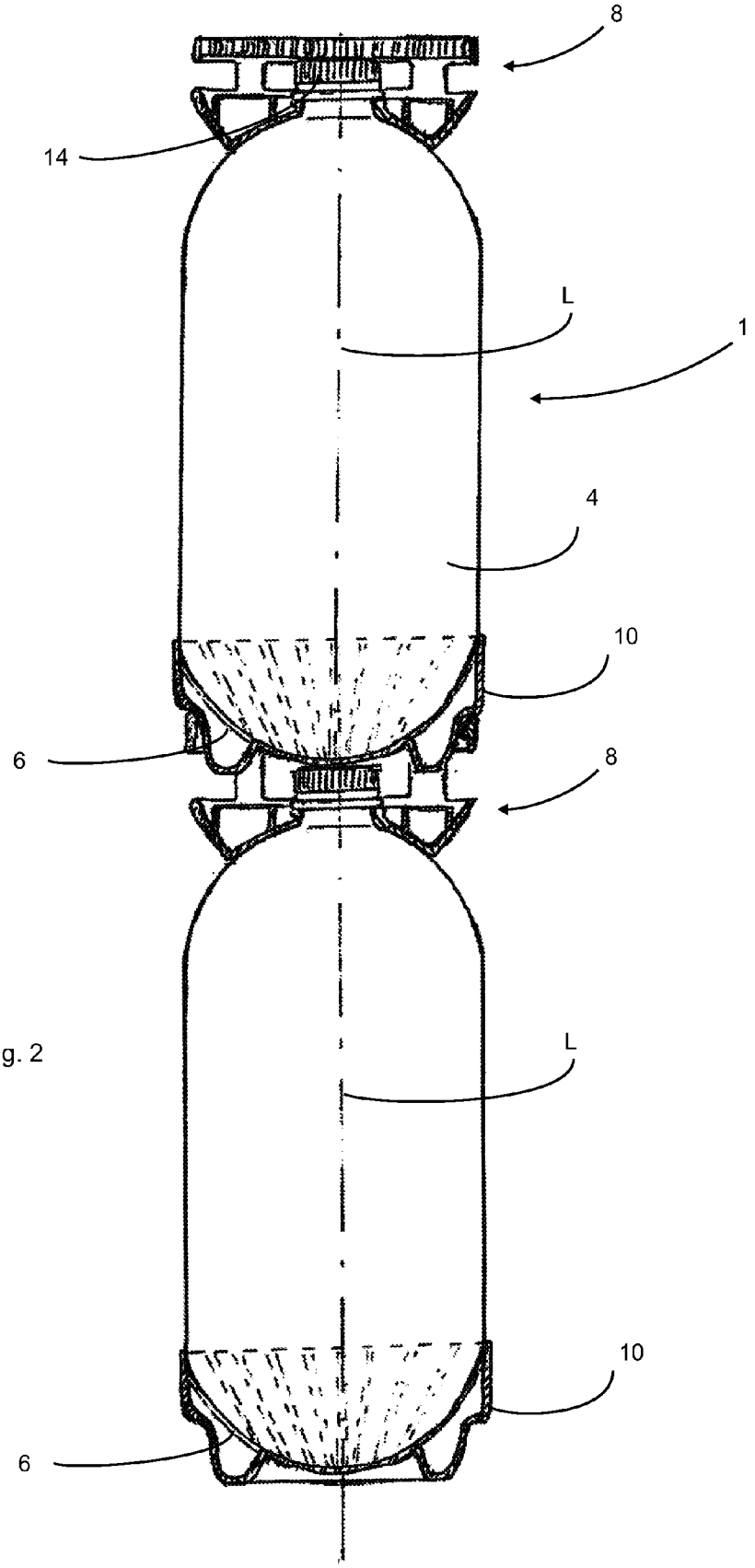
FIG. 2 shows a representation of two containers stacked one above the other.

FIG. 2 shows a representation of two containers 1 disposed one above the other. It will be recognised that the contact part 8 of the lower container can co-operate or interengage respectively with a base cup 10 of the container disposed above it. In this case it is possible that corresponding projections and webs which are adapted to corresponding recesses on the base cup (or vice versa) enable such an interengagement of two containers disposed one above the other. Thus as mentioned above an upper face of the contact element is adapted to an underneath face of the base cup (in particular of a further container).

Figure 3:
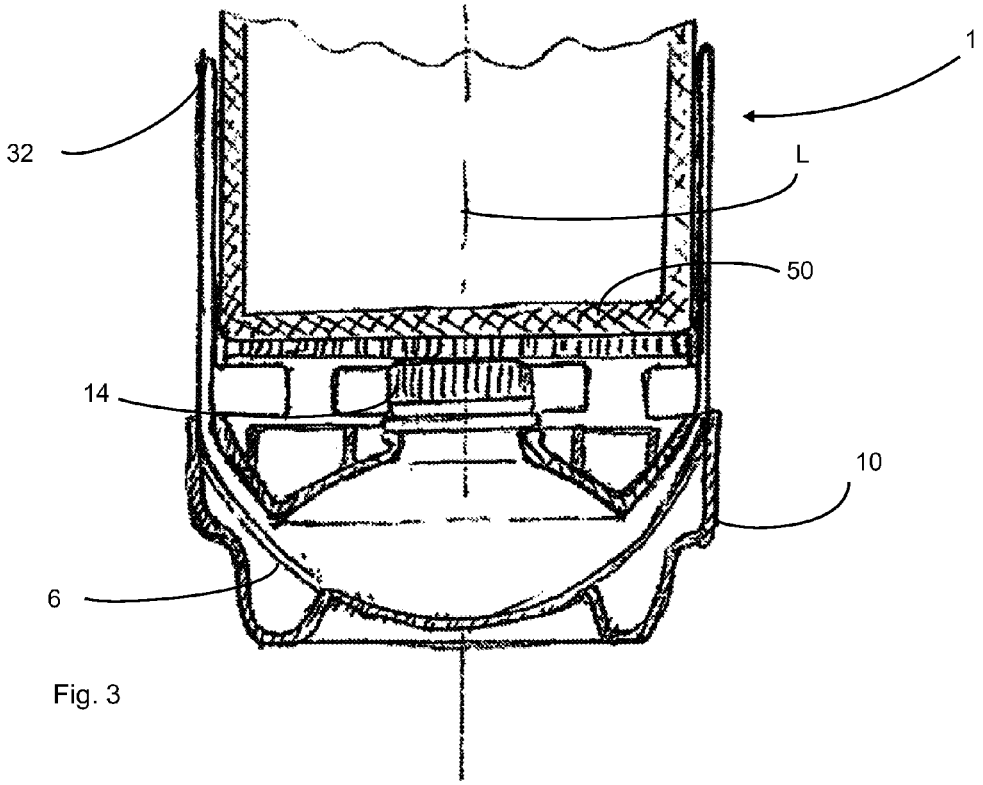
FIG. 3 shows a representation of a folded container.

FIG. 3 shows a representation in which the container has been compressed or folded together respectively by means of a die element. A circumferential fold edge can be seen which is moved downwards during the compression of the container. The reference numeral 50 designates a die which serves for folding of the container. This is in particular a die which is not a component of a tap system but which serves for deforming the plastic containers in order to make them transportable. Within the context of the production it is possible that first of all the container is finished (for example blow moulded) and is then compressed by means of a compression device, in this case in particular by means of the die 50, so that the container can be transported in a more lightweight and space-saving manner.

Figure 4:
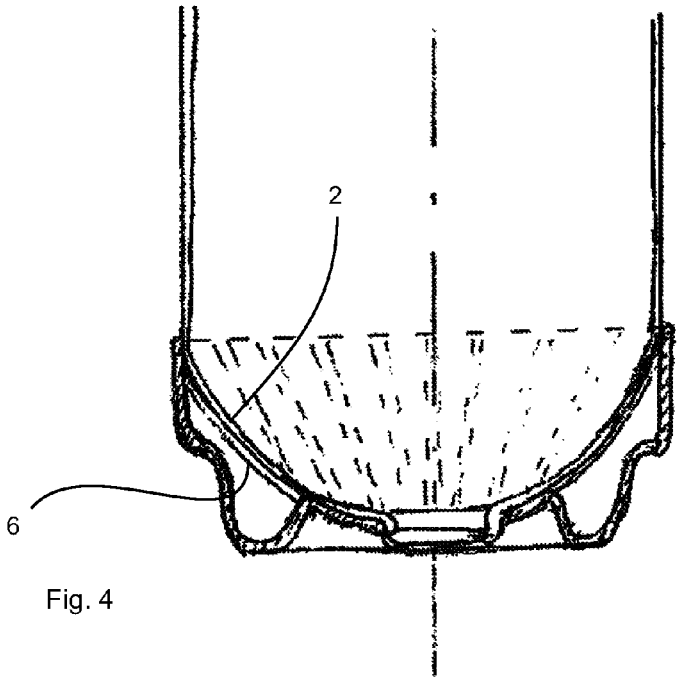
FIG. 4 shows a further representation of a folded container.

FIG. 4 shows a variant of the configuration of the base cup. In addition to the contact element the base cup could also be configured so that it can be clipped on. For this purpose a snap element is conceivable in the centre of the container base on which the base cup can be fastened or snapped on respectively.

Figure 5:
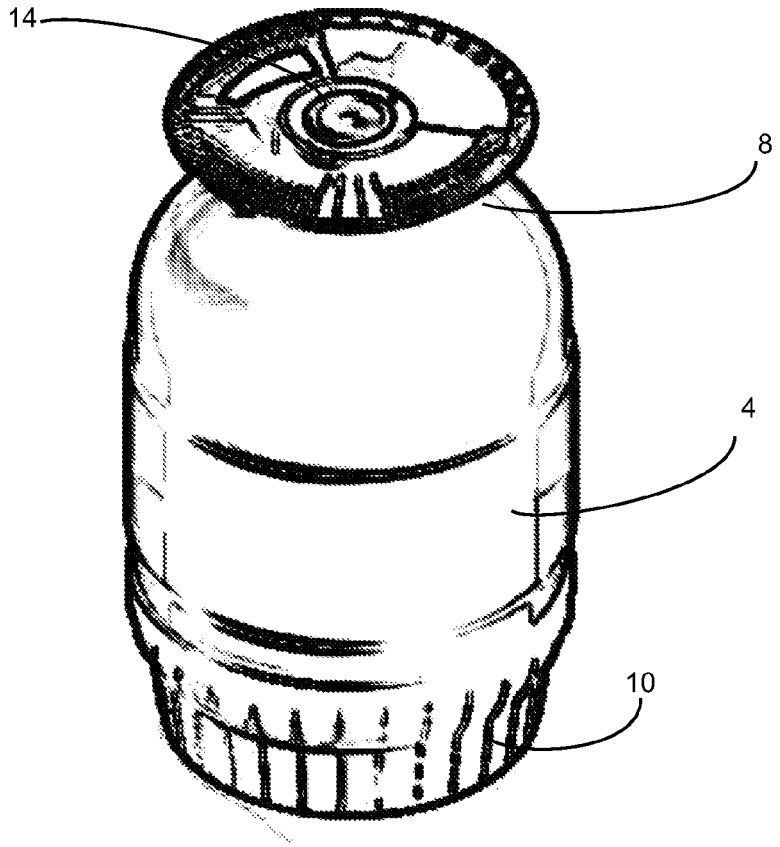
FIG. 5 shows a further perspective representation of a container.

FIG. 5 shows a further perspective representation of a container according to embodiments of the invention. Here too the base cup 10 can be seen as well as the main body 4 and the shoulder region 8. In turn the closure 14 can also be seen which serves for closure of the container. At the same time the contact element 8 can also serve to receive further elements such as for instance a tap line.

Figure 6:
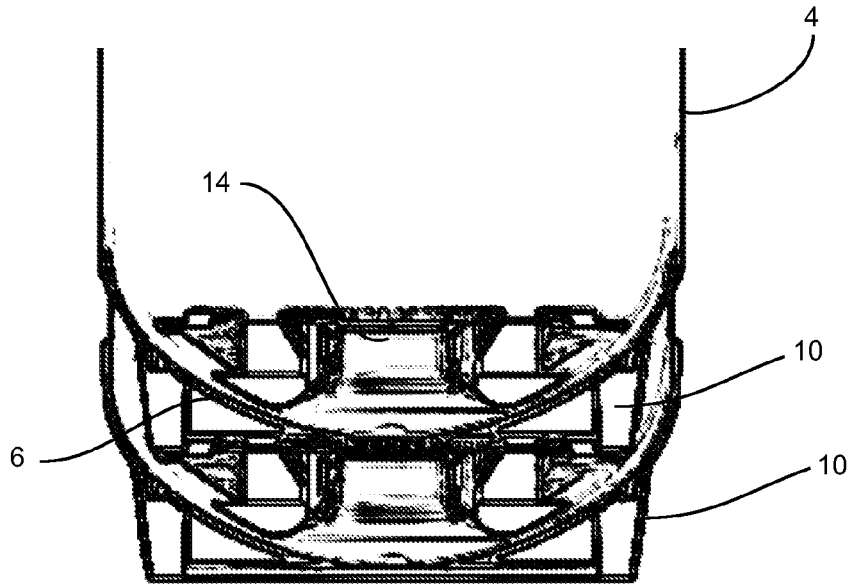
FIG. 6 shows a representation of two containers stacked one inside the other.

FIG. 6 shows a representation of two containers stacked one inside the other. In this case the representation of a container corresponds substantially to FIG. 3, whereby it can be seen that the two containers and also several containers can be stacked one inside the other, so that in this way a transport of the containers is simplified.

Figure 7:
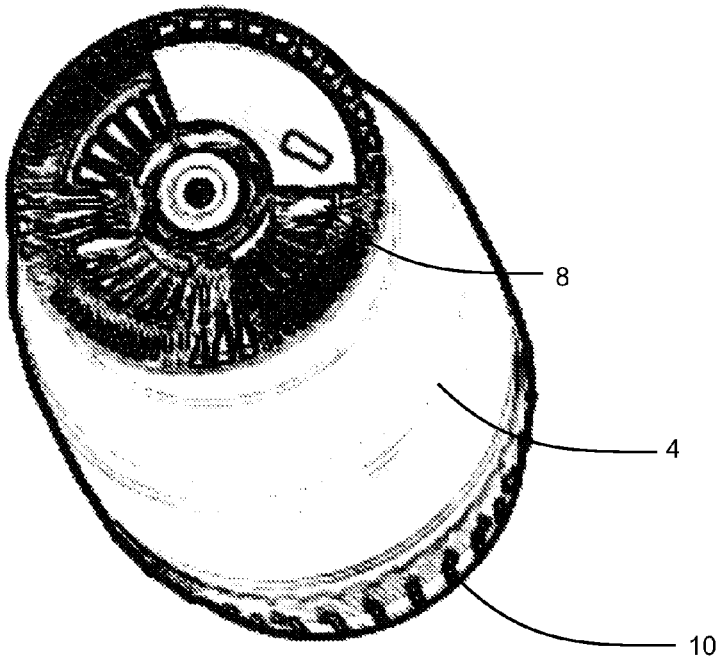
FIG. 7 shows a perspective representation of a container.

FIG. 7 shows a further perspective representation of a container. The base cup 10 and also the contact element 8 can also be seen here. It will be seen that the container as a whole has a convex structure, so that for the purpose of the compression both the contact element and also the base cup 10 can be used and that the container or the main body thereof located between these two elements can be compressed.

Figure 8:
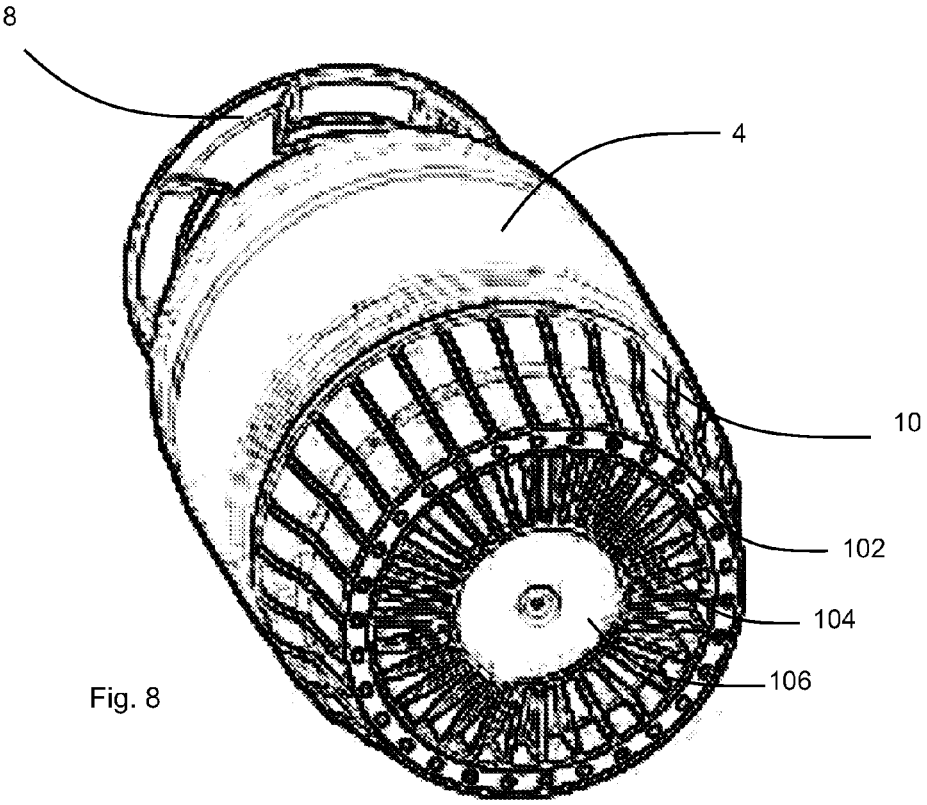
FIG. 8 shows a view from below of the container shown in FIG. 4.

FIG. 8 shows a further representation from below of the container shown in FIG. 7. It can be seen here that the base cup 10 has an annular portion 102 which also serves here as a base surface. Furthermore a plurality of reinforcing ribs 104 can be seen which connect the ring 102 to a central region 106. In this case as mentioned above the region 106 preferably lies flat on the base surface of the particular plastic container.

Figure 9:
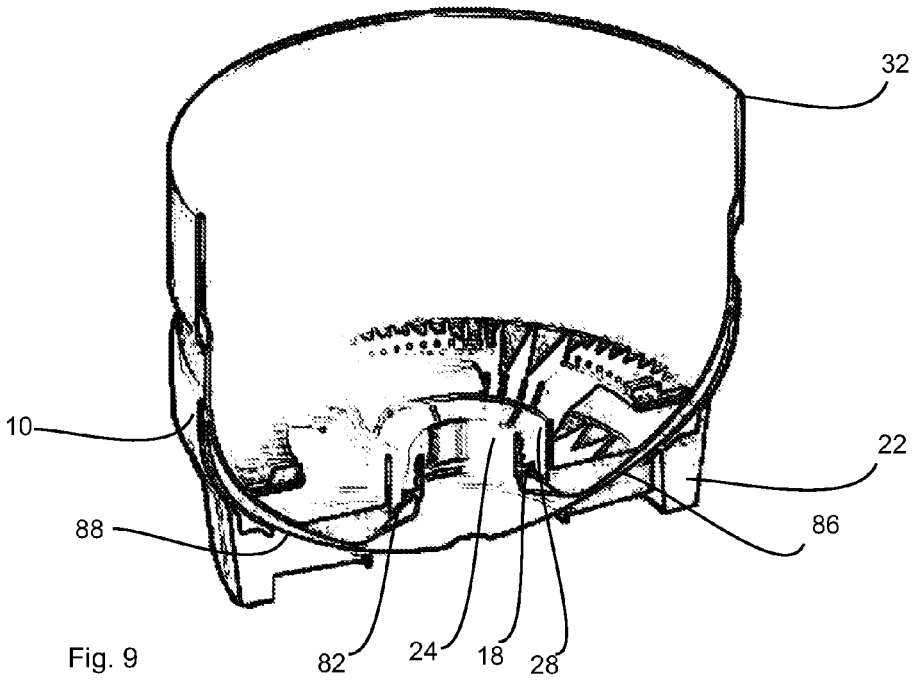
FIG. 9 shows a sectional representation of a folded container.

FIG. 9 shows a sectional representation of a container 1 in a compressed state. Again it can be seen that the base region 6 lies in the base cup. Also the fold edge 32 can again be seen, along which the container has been folded together. The reference numeral 24 designates a mouth region or a mouth of the container and the reference numeral 28 designates an annular receiving section of the contact element 8 which surrounds the mouth region. Fixing sections 82 can also be seen which are disposed on the contact segment and which from below lie in contact on a carrying ring 18 of the container in order thus to fix the contact segment to the container. Furthermore it will be recognised that a downwardly directed surface 86 of the contact element is adapted to an outer surface 88 of the base cup 10, in order as mentioned above to empty the container as completely as possible.

Figure 10:
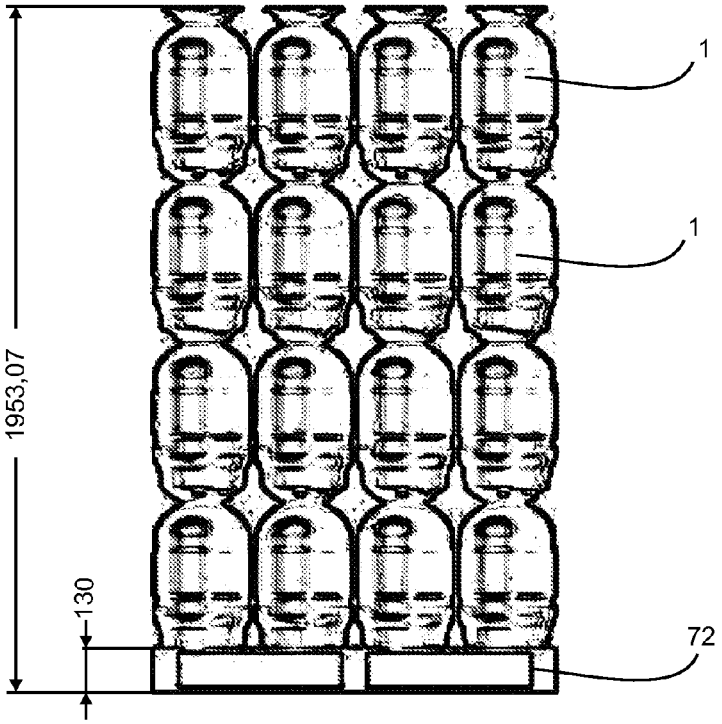
FIG. 10 shows a schematic representation of a plurality of containers stacked one above the other.

FIG. 10 finally shows a plurality of containers stacked one above the other. It will be recognised that with the exception of one base pallet 72 the containers 10 do not require any further pallets but can be stacked directly one above the other.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements. The mention of a "unit" or a "module" does not preclude the use of more than one unit or module.

LIST OF REFERENCE SIGNS

1 container
2 mouth or shoulder region respectively
4 main body
6 base region
8 contact element, die
10 base cup
14 closure
18 carrying ring of the container
22 supporting foot region
24 mouth
26 circumferential vertical section
28 annular receiving section
32 fold edge
50 die
72 base pallet
82 fixing section
86 surface of the contact element
88 surface of the base cup
102 annular section
104 reinforcing ribs
106 central region
A1, A2 regions of the base region 6
A3 region of the shoulder region

The invention claimed is:

1. A plastic container comprising:
a mouth region,
a base region with a bottom surface and side surfaces; and
a main body which adjoins this base region and is suitable to receive a volume of liquid,
wherein the plastic container can be compressed along its longitudinal direction for the removal of liquid located in the plastic container,
a contact element having a body with a downwardly directed surface, said contact element disposable about the mouth region,
a base cup disposable about the base region, said plastic container being compressible between the contact element and the base cup,
wherein when the plastic container is compressed, the downwardly directed surface of the contact element geometrically corresponds to an inner surface of the bottom of the base region of the plastic container to empty the container as completely as possible.

2. The container according to claim 1, wherein an inner wall of the base cup facing the base region of the container is at least in sections adapted to a die element which serves for compressing the container and which is movable relative to the base region in a longitudinal direction of the container.

3. The container according to claim 1, wherein the contact element is designed as a die element and the container can be compressed between the base cup and the die element.

4. The container according to claim 1, wherein a surface of the base cup lying at least partially in contact on the base region of the container and a surface of the contact element lying at least partially in contact on the mouth region of the container are co-ordinated with one another geometrically in such a way that when the contact element and the base cup are advanced towards one another a distance between these surfaces is defined at least in sections substantially only by a wall of the container.

5. The container according to claim 1, wherein the contact element is geometrically adapted to the base cup in such a way that two similar containers can be stacked one above the other in a longitudinal direction of the containers.

6. The container according to claim 1, wherein the contact element has a carrying element with an opening through which a mouth portion of the container can be passed.

7. The container according to claim 1, wherein at least one of the base cup and the contact element are made from a material which is selected from a group of plastic materials which includes polypropylene or polyethylene.

8. The container according to claim 1, wherein the base region, the main body and the mouth region of the container are formed in one piece.

9. The container according to claim 8, wherein a shoulder and the mouth region of the container when pushed into the base region is surrounded by the base cup.

10. The container according to claim 1, wherein the base cup has a convex structure.

11. The container according to claim 1, wherein said base cup which forms a base surface for the container and which when the container is compressed can also serve as a die element or a die counter-element for compressing the container.

12. The container according to claim 1, wherein the mouth region of the container, which in an uncompressed state of the container is located outside a hollow space surrounded by the base cup and is located inside the hollow space surrounded by the base cup when in a compressed state, and wherein a fold edge is formed in the container during compression such that when the container is compressed, said fold edge is outside a hollow space surrounded by the base cup.

13. Die elements for use with a plastic container, said plastic container has having a mouth region, a base region, and a main body which adjoins this base region and is suitable to receive a volume of liquid, wherein the container can be compressed along its longitudinal direction for removal of liquid located in the plastic container, said die elements comprising:

a contact element having a body with a downwardly directed convex surface, said contact element disposable about the mouth region, a base cup, disposable about the base region, said plastic container being compressible between the contact element and the base cup, wherein when the plastic container is compressed, the downwardly directed convex surface of the contact element geometrically corresponds to an inner surface of the base region of the plastic container to empty the container as completely as possible.

* * * * *